US006454124B1

(12) United States Patent
Edwards et al.

(10) Patent No.: US 6,454,124 B1
(45) Date of Patent: Sep. 24, 2002

(54) MUD PAN

(75) Inventors: Toby Edwards; David F. Kreitzer; Dan B. Pool, all of Phoenix, AZ (US)

(73) Assignee: Equity Earnings Corp., Phoenix, AZ (US)

( * ) Notice: Subject to any disclaimer, the term of this patent is extended or adjusted under 35 U.S.C. 154(b) by 0 days.

(21) Appl. No.: 09/844,877

(22) Filed: Apr. 27, 2001

Related U.S. Application Data

(60) Provisional application No. 60/200,614, filed on Apr. 28, 2000.

(51) Int. Cl.[7] ..... B65D 25/24
(52) U.S. Cl. ..... 220/636; 220/690; 220/4.32
(58) Field of Search ..... 220/4.28, 4.32, 220/DIG. 25, 916, 690, 636

(56) References Cited

U.S. PATENT DOCUMENTS 2,700,485 A * 1/1955 Goldberg et al. ..... 20/690
5,509,561 A * 4/1996 Kanterovitch ..... 220/4.28
5,603,428 A 2/1997 Breckwoldt

FOREIGN PATENT DOCUMENTS

GB 1134859 * 11/1968 ..... 220/690

* cited by examiner

*Primary Examiner*—Stephen Castellano
(74) *Attorney, Agent, or Firm*—Parsons & Goltry; Robert A. Parsons; Michael W. Goltry

(57) ABSTRACT

A mud pan for holding and mixing materials including a body fabricated of sheet material formed into a trough having a pair of upper edges and opposing ends. The body has an inner surface with straight sides and a curved bottom and an outer surface with a curved bottom. A coupling assembly removably couples opposing end caps to the ends of the body.

9 Claims, 4 Drawing Sheets

MUD PAN

This application claims the benefit of Provisional Application Serial No. 60/200,614, filed Apr. 28, 2000.

FIELD OF THE INVENTION

This invention relates to containers.

More particularly, the present invention relates to mixing and holding vessels for wall finishing materials.

In a further and more specific aspect, the instant invention concerns a mud mixing and holding vessel.

BACKGROUND OF THE INVENTION

During construction or wall finishing projects, it is often necessary to prepare and hold various materials such as joint compound or mud, etc. Joint compound containers are known in the trade as mud pans, and typically include a flat bottom with sidewalls extending at an angle upwardly therefrom. The bottom and side walls form sharp angles which can hinder the preparation process by collecting powdered materials and prevent uniform mixing. Additionally, the sharp angles make removing material from the container difficult.

Mud is often mixed hot. In conventional pans, the heat from the pan can be uncomfortable to an individual holding the pan. The edges and width of the bottom can also result in an unsecure and uncomfortable grip. An individual holding a conventional pan for long periods of time may develop strain in the hand and arm holding the pan. When a pan is manipulated, such as picked up or set down, generally two hands are required to be able to position one hand under the pan. Thus, the pan cannot be set down at will as this requires freeing the other hand of tools or other items.

Mud pans are typically constructed of metal, such as stainless steel. While relatively easily cleaned, materials can collect and dry on the surfaces. Over time, the container can become battered and scratched, reducing the ease of use and increasing the chance of an incomplete cleaning. In other words, the container can become unusable. When this occurs, the pan is discarded for a new one. This can be expensive and wasteful.

It would be highly advantageous, therefore, to remedy the foregoing and other deficiencies inherent in the prior art.

Accordingly, it is an object of the present invention to provide a new and improved mud pan.

Another object of the invention is to provide a mud pan that can comfortably be held in one hand.

And another object of the invention is to provide a mud pan that can be manipulated with one hand.

Still another object of the present invention is to provide a mud pan which will facilitate mixing and removal of materials.

Yet another object of the invention is to provide a mud pan which can be easily repaired.

SUMMARY OF THE INVENTION

Briefly, to achieve the desired objects of the instant invention in accordance with a preferred embodiment thereof, provided is a mud pan for holding and mixing materials including a body fabricated of sheet material formed into a trough having a pair of upper edges and opposing ends. The body has an inner surface with straight sides and a curved bottom and an outer surface with a curved bottom. A pair of opposing end caps are coupled to the ends of the body.

In a specific embodiment, the mud pan includes a grip extending between opposing end caps adjacent an outer surface of the bottom of the body. The grip can include an upper surface curved to closely match the outer surface of the curved bottom and thickened opposing longitudinal edges to provide an easily gripped structure.

In a more specific embodiment, the mud pan includes a coupling assembly. The coupling assembly includes a plurality of tabs extending from each of the opposing ends of the body. A groove extends around the periphery of an inner surface of each end cap and corresponds to the shape of the opposing ends of the body. A plurality of slots, corresponding to the plurality of tabs, are formed in each groove and through each end cap. The plurality of tabs extend through the slots in the end caps and are folded over locking the end caps in position.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
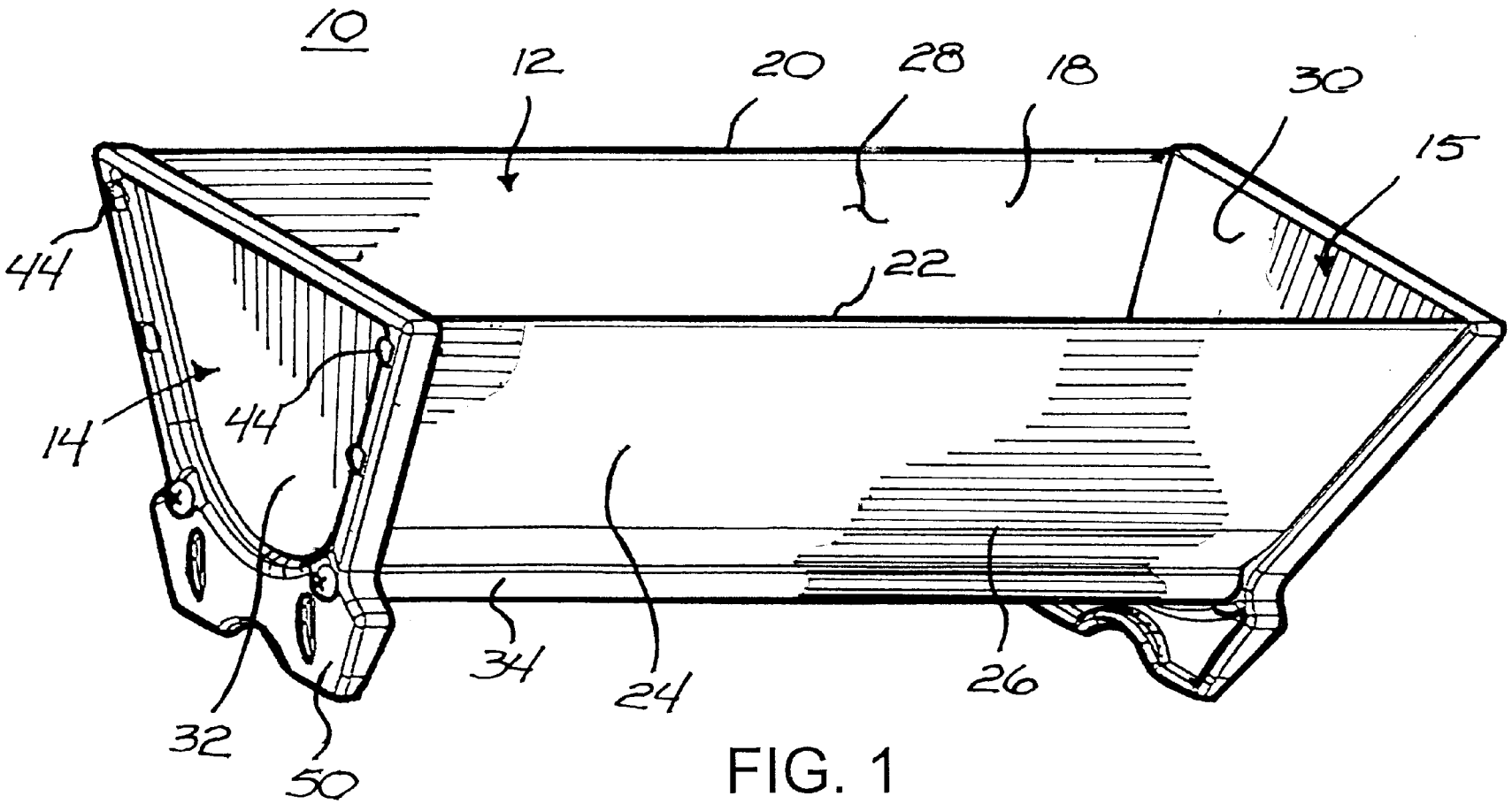
FIG. 1 is a top perspective view illustrating a mud pan in accordance with the present invention.
Figure 2:
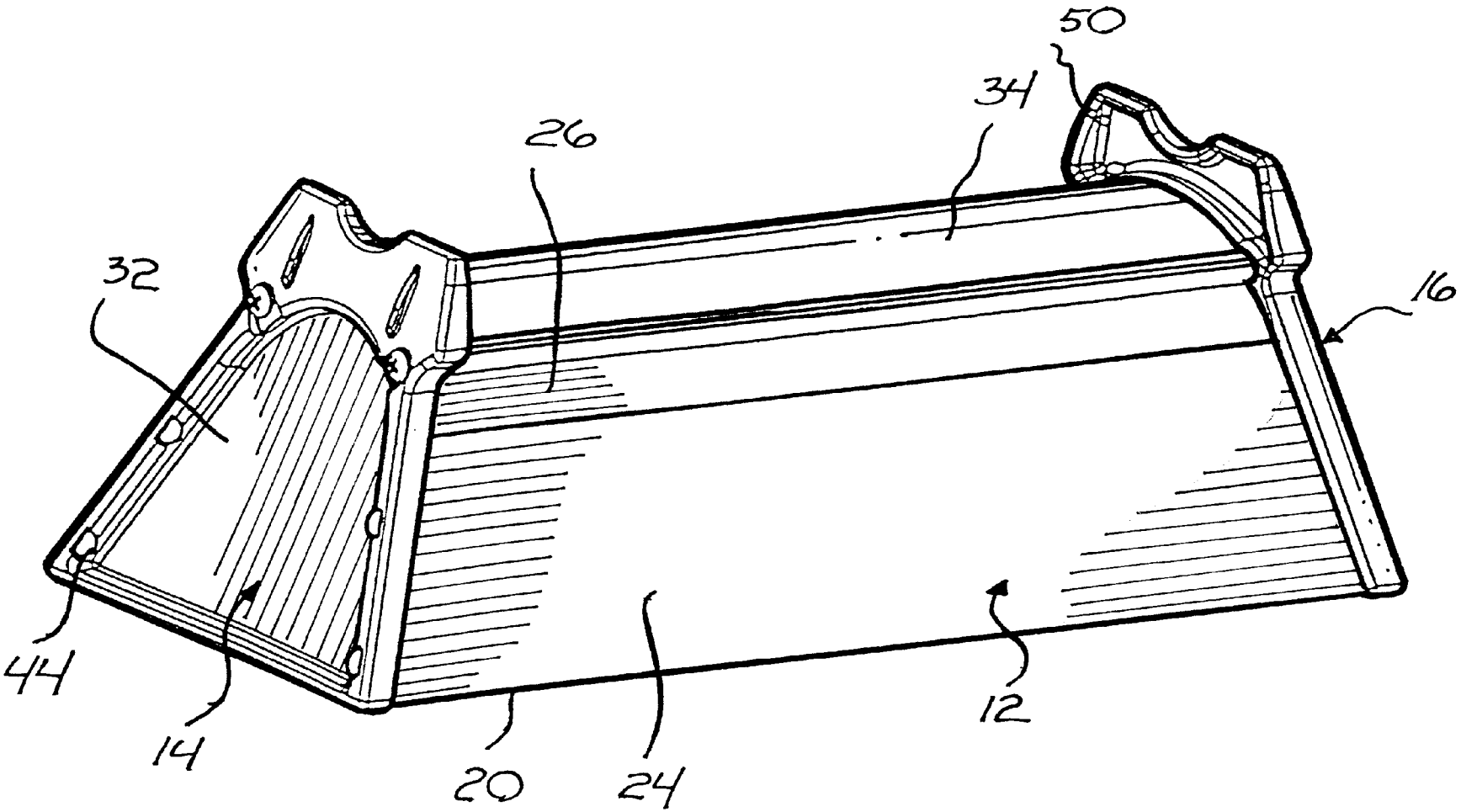
FIG. 2 is a bottom perspective view illustrating the mud pan of FIG. 1.

Turning now to the drawings in which like reference characters indicate corresponding elements throughout the several views, attention is first directed to FIGS. 1 and 2 which illustrate a mud pan generally designated 10 and constructed in accordance with the teachings of the present invention. Mud pan 10 includes a body 12 carried between opposing end caps 14 and 16. Body 12 is preferably a sheet of material such as plastic, metal etc., which is bent into a trough shape having straight sides and a rounded bottom. Body 12 includes an inner surface 18 curved at the bottom, having straight sides and terminating in a pair of upper edges 20, 22, and an outer surface 24 having a curved bottom 26. Inner surface 18 of body 12 and end caps 14 and 16 define a volume 28. End caps 14 and 16 each include an inner surface 30 and an outer surface 32. A grip 34 is positioned adjacent bottom 26 of body 12, attached to and extending between end caps 14 and 16.

Figure 3:
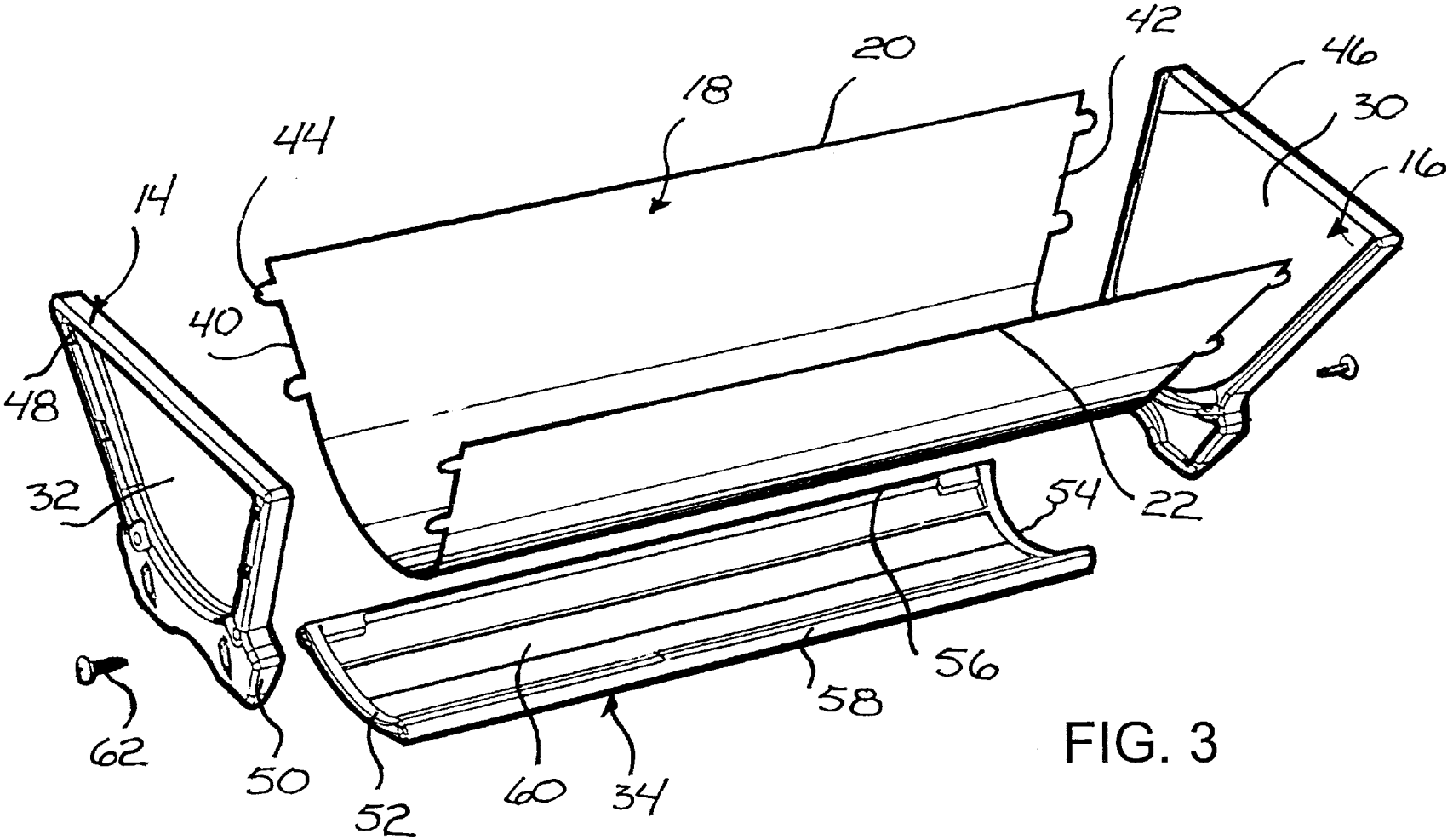
FIG. 3 is an exploded view of the mud pan of FIGS. 1 and 2.

Turning now to FIG. 3, body 12 includes ends 40 and 42 from which tabs 44 extend. In this embodiment, body 12 is fabricated of a malleable material such as sheet metal. The nature of the material permits tabs 44 to be bent and remain in the bent position. End plates 14 and 16 include a groove 46 extending around the periphery of inner surface 46, corresponding to the shape of ends 40 and 42 of body 12. Slots 48 corresponding to tabs 44 are formed in groove 46, extending from inner surface 30 to outer surface 32. End plates 14 and 16 are coupled to body 12 by receiving tabs 44 through slots 48, positioning ends 40 and 42 into the respective groove 46 of the respective end cap 14 and 16. Tabs 44 extend beyond outer surface 32 of end caps 14 and 16 and are folded over (FIGS. 1 and 2), locking the end caps in position.

Still referring to FIG. 3, end caps 14 and 16 also include foot members 50 which extend below body 12. Grip 34 includes opposing ends 52 and 54, opposing edges 56 and 58 extending from end 52 to end 54, and an upper surface 60. Upper surface 60 is curved to closely match the curve of bottom 26. Edges 56 and 58 are preferably thickened or flared, to provide an easily gripped structure. Grip 34 is attached to pan 10 by fastening means such as fasteners, clips, pins, adhesives, welds, etc. In this embodiment, screws 62 extend through end plates 14 and 16 and are received by ends 52 and 54 of grip 34. Grip 34 is preferable fabricated of plastic. Grip 34 provides a secure element to keep hands from slipping, insulates them from hot or cold temperatures of the materials carried in volume 28 and reduces the gripping energy required thereby reducing cramping in forearms and hands.

Figure 4:
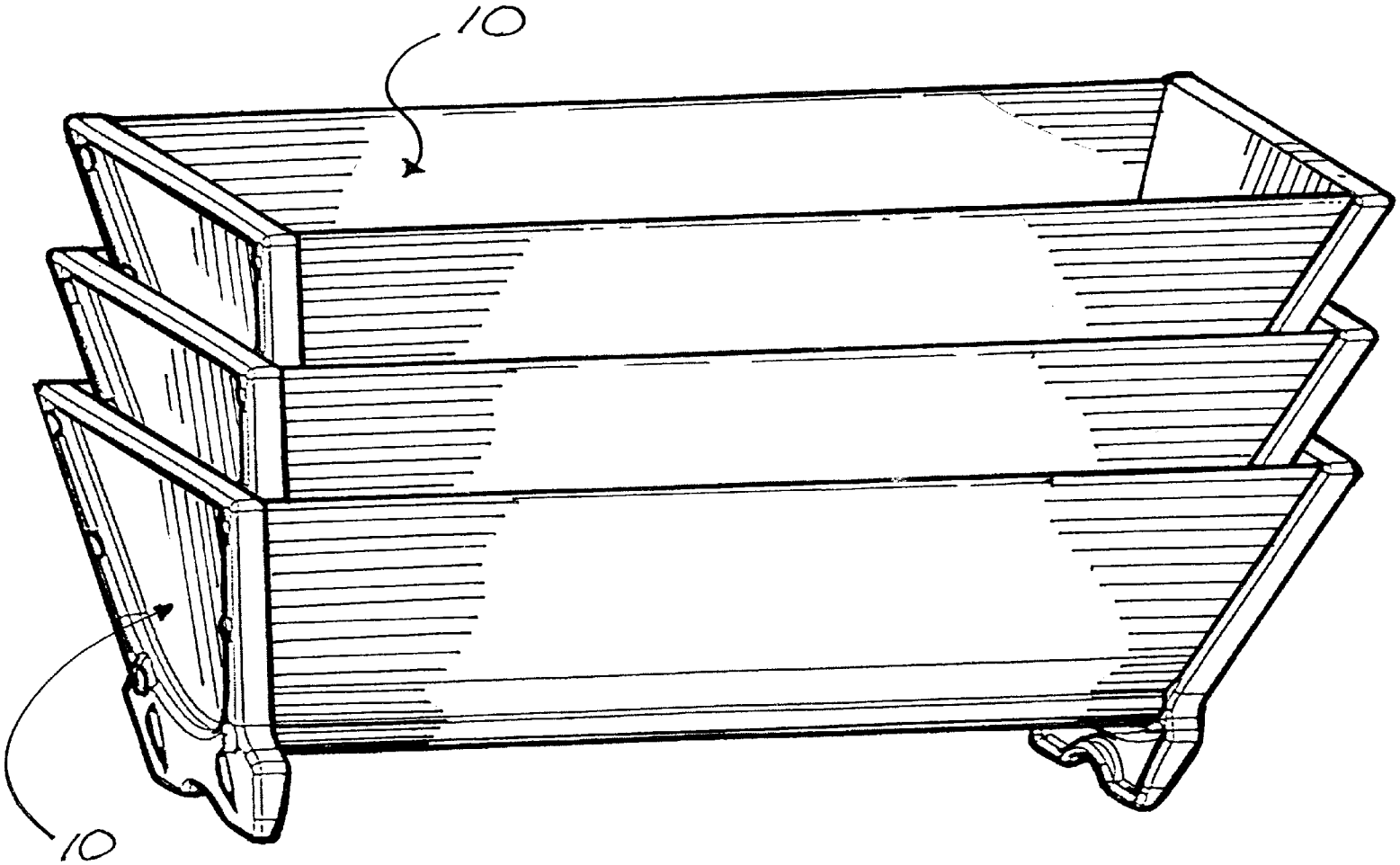
FIG. 4 is a perspective view of a plurality of stacked mud pans according to the present invention.

Inner surface 18 of mud pan 10 is rounded at the bottom to eliminate tight radius bends or corners in which mud accumulates. The sides are straight to facilitate scraping thereof with a mud knife. In this manner, the ease with which mud is removed from the pan is increased and cleaning is also simplified. The unique shape also permits a plurality of mud pans to be stacked for storage, shipping etc. (FIG. 4).

With reference to FIG. 3, it can be seen that body 12 is replaceable. When, for example, inner surface 18 becomes marred, or has accumulated dried materials making mixing and removal of material difficult, body 12 can be simply replaced. Any of the components of pan 10 can be easily and quickly replaced, thereby preventing the need to replace the entire pan when a single portion is damaged or worn.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A mud pan for holding and mixing materials, comprising:

opposing end caps;

a body having a trough shape with straight sides and a curved bottom, the body carried between and removably coupled to opposing end caps;

a grip extending between opposing end caps adjacent an outer surface of the bottom of the body; and wherein the opposing end caps each include foot members extending generally from proximate the outer surface of the bottom of the body beyond the grip.

2. A mud pan as claimed in claim 1 wherein the grip includes an upper surface curved to closely match the outer surface of the curved bottom.

3. A mud pan as claimed in claim 2 wherein grip further includes opposing longitudinal edges, the opposing longitudinal edges thickened to provide an easily gripped structure.

4. A mud pan for holding and mixing materials, comprising:

a body fabricated of sheet material formed into a trough having a pair of upper edges and opposing ends, the body having an inner surface with straight sides and a curved bottom and an outer surface having a curved bottom;

a pair of end caps; and a coupling assembly removably coupling the opposing end caps to the ends of the body, the coupling assembly including a plurality of tabs extending from each of the opposing ends of the body, a groove extending around the periphery of an inner surface of each end cap, the groove corresponding to the shape of the opposing ends of the body, and a plurality of slots, corresponding to the plurality of tabs, formed in each groove and through each end cap wherein the plurality of tabs extend through the slots in the end caps and are folded over locking the end caps in position.

5. A mud pan as claimed in claim 4 including a grip extending between opposing end caps adjacent the outer surface of the bottom of the body.

6. A mud pan as claimed in claim 5 wherein the grip includes an upper surface curved to closely match the outer surface of the curved bottom.

7. A mud pan as claimed in claim 6 wherein grip further includes opposing longitudinal edges, the opposing longitudinal edges thickened to provide an easily gripped structure.

8. A mud pan as claimed in claim 4 wherein the opposing end caps each include foot members extending generally beyond the outer surface of the bottom of the body.

9. A mud pan for holding and mixing materials, comprising:

opposing end caps;

a body having a trough shape with straight sides and a curved bottom carried between and removably coupled to opposing end caps, the body including an inner surface, opposing ends, and terminating in a pair of upper edges, the inner surface and opposing end caps defining a volume; and a coupling assembly removably coupling the opposing end caps to the ends of the body, the coupling assembly including a plurality of tabs extending from each of the opposing ends of the body, a groove extending around the periphery of an inner surface of each end cap, the groove corresponding to the shape of the opposing ends of the body, and a plurality of slots, corresponding to the plurality of tabs, formed in each groove and through each end cap wherein the plurality of tabs extend through the slots in the end caps and are folded over locking the end caps in position.

* * * * *